United States Patent [19]

Aubry et al.

[11] Patent Number: 5,038,149

[45] Date of Patent: Aug. 6, 1991

[54] ANTENNA WITH THREE-DIMENSIONAL COVERAGE AND ELECTRONIC SCANNING, OF THE RANDOM SPARE VOLUME ARRAY TYPE

[75] Inventors: Claude Aubry, Grigny; Jean-Louis Pourailly, Vincennes; Joseph Roger, Bures sur Yvette, all of France

[73] Assignee: Thomson-CSF, Puteaux, France

[21] Appl. No.: 448,981

[22] Filed: Dec. 12, 1989

[30] Foreign Application Priority Data

Dec. 16, 1988 [FR] France ..... 88 16622

[51] Int. Cl.[5] ..... H01Q 3/22; H01Q 3/24; H01Q 3/26

[52] U.S. Cl. ..... 342/372; 343/890; 343/893

[58] Field of Search ..... 342/368, 372; 343/890, 343/891, 893, 844

[56] References Cited

U.S. PATENT DOCUMENTS 3,653,057 3/1972 Charlton ..... 343/876
4,052,723 10/1977 Miller .
4,825,222 4/1989 Butcher ..... 343/891

FOREIGN PATENT DOCUMENTS 0207511 1/1987 European Pat. Off. .
1591060 8/1970 Fed. Rep. of Germany .
2822845 11/1979 Fed. Rep. of Germany .

OTHER PUBLICATIONS

Patent Abstracts of Japan, vol. 12, No. 60, (E-584) (2907), Feb. 23, 1988, & JP-A-62 203402, T. Shiokawa, "Antenna System for Mobile Satellite Communication".

*Primary Examiner*—Theodore M. Blum
*Attorney, Agent, or Firm*—Oblon, Spivak, McClelland, Maier & Neustadt

[57] ABSTRACT

An antenna of the random spare volume array type comprising a plurality of elementary antennas with almost omnidirectional individual radiation distributed according to a statistically isotropic random relationship of distribution within an enveloping volume having a shape generated by revolution, the mean spacing between elementary antennas being notably greater than a half wavelength of the minimum frequency to be received or transmitted, each elementary antenna being connected to an active module comprising individually controllable phase-shifters themselves connected to a common distributor. According to the disclosure, the elementary antennas are formed by dipoles oriented vertically and supplied by a supply line comprising a first section, extending horizontally between the respective dipole and a common vertical tower coaxial with the enveloping volume having a shape generated by revolution, and a second section extending to the interior of this tower and ending in the distributor. The antenna thus made has a vertical polarization which is advantageous in many examples of use (navy, secondary radars etc.) with, owing to the use of simple dipoles, a very small reflecting surface that makes it very difficult to localize. Furthermore, through this structure, the first sections of the supply lines may easily be self-supporting for the mechanical support of the dipoles on the common vertical tower formed, for example, by a ship's mast.

7 Claims, 2 Drawing Sheets

ANTENNA WITH THREE-DIMENSIONAL COVERAGE AND ELECTRONIC SCANNING, OF THE RANDOM SPARE VOLUME ARRAY TYPE

BACKGROUND OF THE INVENTION

1. Field of the Invention

The present invention concerns an antenna with three-dimensional coverage and electronic scanning, of the random spare volume array type.

2. Description of the Prior Art

There are several known types of antennas that make it possible to obtain a three-dimensional coverage (most usually a hemispherical or almost-hemispherical coverage) using a configuration of fixed elements combined with electronic scanning, namely an antenna wherein the shape of the radiation pattern (notably the direction of a major lobe) is modified by playing on the individual, adjustable phase shifts of the different elements forming the array.

The configuration most commonly used, in practice, to make an antenna such as this consists in distributing the different elementary antennas of the array over one or more reflecting surfaces such as, for example, the surface of a cylinder or a plurality of differently oriented panels.

These antennas, of the so-called surface array type, are not however satisfactory in all respects. For example:

the cylindrical surface array has the drawback of mediocre coverage for relatively great elevation angles, that is when the direction of the zenith is approached;

the multiple-panel antennas enable this drawback to be overcome by placing the different panels (generally four in number) on the faces of a truncated pyramid, thus enabling a relatively satisfactory hemispherical coverage to be obtained.

However, these multiple-panel antennas are relatively costly, for each panel, and hence each antenna of the array, works in only one quadrant (in the case of an antenna with four panels).

As a matter of fact, for a given direction of the major lobe, only one of the four panels is used, and the elementary antennas of the other three panels in no way contribute to the formation of the beam in this direction.

As a result, to have total azimuthal coverage available, the number of antennas and phase-shifter modules have to be quadrupled, thus correlatively placing a burden on the cost of the entire unit.

Besides, there is another known type of antenna with three-dimensional coverage and electronic scanning wherein, unlike in multiple-panel or cylindrical surface antennas, all the elementary antennas of the array take part in the formation of the beam and contribute to the gain of the antenna, irrespectively of the direction of the major lobe.

These antennas are so-called "volume" antennas wherein, unlike in surface antennas, the elementary antennas are no longer distributed on the surface of a given plane or given volume but within a volume, (generally a sphere).

The elementary antennas are distributed in this volume as unevenly as possible so as to minimize the mutual coupling among elementary antennas and thus attenuate the lobes of the array to the maximum extent. This condition is obtained by distributing the antennas in the volume according to a statistically isotropic random relationship of distribution and, furthermore, by providing for a mean spacing between elementary antennas that is, notably, greater than a half wavelength.

We thus speak of a "random spare array". In arrays such as this:

the sparing process enables economizing on the number of radiating elements for a given dimension of the array, i.e. for a given aperture of the array. It also enables a sharp reduction in the couplings among sources, which are frequent causes of deterioration in the performance characteristics of array antennas; and the randomness enables the elimination of the lobes of the array inherent in regular structures with large pitches.

An antenna such as this has been described notably in the document DE-A-28 22 845.

More precisely, this document describes a so-called "crow's nest" antenna, namely an antenna formed by an array wherein the elementary antennas are open loops or turnstile antennas radiating on a horizontal polarization and placed at the top of the vertical coaxial lines of supply.

Although it appears to be an approach that is very worthwhile for an antenna with three-dimensional coverage and electronic scanning, this type of antenna, while having been proposed for more than 10 years, has been made only on an experimental basis until now, without any effective application to the different fields where an antenna of such a type might prove to be particularly desirable, namely fields such as those of air and naval defence, radar for weapons systems, secondary radars for aviation etc.

For, first of all, the length of the coaxial lines (of which the longest ones have a length equal to at least twice the radius of the enveloping sphere) makes the system mechanically weak. Hence, if it is desired to have the requisite precision of positioning of the different loops inside the sphere along with adequate overall rigidity, it becomes necessary to provide for additional mechanical mean such as nylon threads holding the semi-rigid supply cables in position and/or means to bury the entire array in a mass of foam (polyurethane foam for example).

In addition to the difficulties of mechanical implementation, in the latter case, the presence of foam plays the role of a thermal insulator which prevents the removal of calories if the antenna should be used in transmission. This point restricts this approach to low-power reception or transmission antennas and the problem of removal of calories is unresolved.

A second drawback, also related to the great length of the supply lines, is the inherent phase shift introduced by these lines. This phase shift may vary in great proportions (depending on whether the line is short or long) and it will be necessary to provide for compensation to prevent the appearance of phase errors independent of the direction of aim.

These drawbacks, both mechanical and electrical, related to the great length of the supply lines, are all the more inconvenient as the dimensions of the sphere are greater than the wavelength. Now, the fact that the narrowness of the beam (the angle of aperture of the major lobe) is directly related to the dimension (expressed in wavelengths) of the sphere leads to restricting the performance characteristics of the system as regards its beam narrowness.

Thirdly, a array such as this is highly "visible" in terms of radar signature, owing to the use of loops or turnstile antennas. Now, the use of such types of elementary antennas is inevitable because, by its nature, an array requires antennas with a pattern that is azimuthally almost omnidirectional in amplitude as well as in phase.

Fourthly, owing to its structure, this known type of antenna is restricted to working essentially in horizontal polarization.

Now, a great many applications absolutely call for a vertical polarization. This is the case, for example, with onboard radar antennas in ships (for, the vertical polarization gets rid of the effects of reflection on the sea) or again for antennas for secondary radars, notably IFF (Identification Friend or Foe) radars.

These different reasons explain the reason why, despite its obvious theoretical advantages and the need for an antenna with three-dimensional coverage and electronic scanning in many fields of application, this known type of antenna has not gone beyond the experimental stage until now.

SUMMARY OF THE INVENTION

An object of the present invention is an antenna of the random spare volume array type described further above which overcome all the above-mentioned drawbacks while, at the same time, retaining a structure that is simple, sturdy and, therefore, costs little to make.

This antenna is formed, in a manner known per se, by a fixed array comprising a plurality of elementary antennas with substantially omnidirectional individual radiation distributed according to a statistically isotropic random relationship of distribution within an enveloping volume having a shape generated by revolution, the mean spacing between elementary antennas being notably greater than a half wavelength of the minimum frequency to be received or transmitted, each elementary antennas being connected to individually controllable phase-shifter means themselves connected to common distributing means.

In a manner characteristic of the present invention, the elementary antennas are formed by dipoles oriented vertically and supplied by a supply line comprising a first section, extending horizontally between the respective dipole and a common vertical tower coaxial with the enveloping volume having a shape generated by revolution, and a second section extending to the interior of this tower and ending in the distributing means.

The enveloping volume having a shape generated by revolution may notably be a sphere.

Very advantageously, the first sections of the supply lines form self-supporting means for the mechanical support of the dipoles on the common vertical tower.

As compared with a crow's nest antenna, a major reduction is thus achieved in the length of the sections of the supply lines which form the self-supporting means: the maximum length of these means is, at the most, equal to the radius of the sphere (more precisely, it is equal to the radius of the sphere less the radius of the central cylinder) while, in the prior art crow's nest structure described further above, this length was at least equal to twice the radius of the sphere.

In view of the reduced length, it is no longer necessary to bury the array in a foam or to provide for ancillary supporting means.

From the radio-electrical point of view, the central tower only moderately disturbs the radiation pattern and, in any case, has no effect on the azimuthal isotropy of the beam owing to its axial position. In other words, the non-uniformity introduced by the central cylinder will be essentially a non-uniformity in elevation where a deterioration of the performance characteristics of the array in the vicinity of the zenithal region are quite accepted.

Furthermore, in the case of a radar for naval use, the central tube may be advantageously formed by a ship's mast or by a similar superstructural element, thus making it easier to seek an appropriate location for the antenna and making the mast neutral from a radio-electrical point of view. This advantage is particularly appreciable in ships, where superstructural elements close to the antenna always contribute major disturbances to the pattern. Besides, the structure of the antenna makes it possible to easily place the active modules, which are inside the vertical tower and hence are in the vicinity of the elementary antennas, on the supply line, thereby increasing their efficiency to that extent.

Finally, owing to the use of simple dipoles as elementary antennas, the array can be made practically invisible in terms of its radar signature by choosing very thin wires for the making of the dipoles, hence wires that have a very small equivalent reflecting surface (unlike in loops or turnstiles of the prior art).

BRIEF DESCRIPTION OF THE DRAWINGS

Other characteristics and advantages of the present invention will appear from the following detailed description, made with reference to the appended drawings, of which.

DESCRIPTION OF PREFERRED EMBODIMENTS

Figure 1:
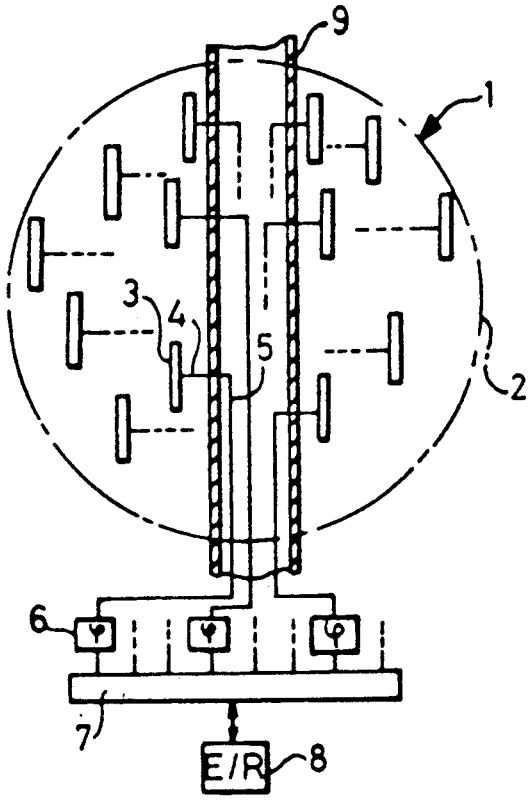
FIG. 1 shows a schematic view of an embodiment of the antenna according to the teachings of the present invention.
Figure 2:
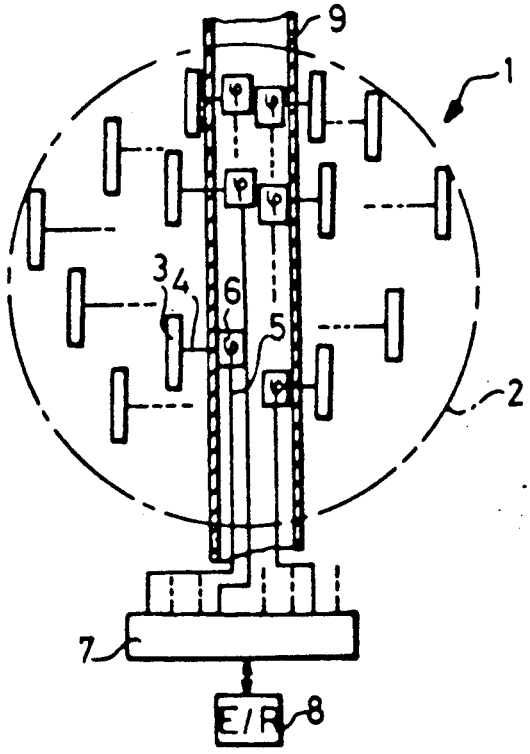
FIG. 2 shows an alternative embodiment of the antenna of FIG. 1, wherein the active modules are placed in the central tower, in the vicinity of their associated, respective elementary antennas.

FIGS. 1 and 2 give a schematic view of the array according to the invention.

It will be noted that, for the clarity of the drawing, the respective proportions among the lengths of the different elementary antennas (one half wavelength), their respective spacings (of the order of several wavelengths), the diameter of the enveloping volume (of the order of several wavelengths or several tens of wavelengths) and the diameter of the central tower (of the order of one wavelength or a fraction of a wavelength) have not been maintained.

Besides, as shall be seen further below, the different dimensions that we have indicated may vary in high proportions as a function of the performance values (gain, narrowness of the beam etc.) desired for the array.

The structure essentially has a array 1 formed of a plurality of elementary antennas formed by simple vertical dipoles 3, distributed randomly inside a enveloping volume 2 in accordance with the principles of random, spare arrays which have been explained further above.

The dipoles 3 are each connected by an inherent supply line 4, 5 to an active module 6.

(The term "active module" implies an electronic module comprising at least one individually controllable phase-shifter circuit, but one that could further comprise, amplifier and filtering circuits, transmission means, reception means etc., depending on the functions assumed by the antennas and on the types of signals that it might have to transmit or receive).

The different active modules 6 all end in an antenna distributor 7 which is itself connected to the transmission and/or reception circuits 8.

The supply lines of each dipole are formed by two sections 4 and 5.

The first section 4 is essentially horizontal to be transparent (from the radio-electrical point of view), given the vertical polarization obtained by the antenna.

Besides, from the mechanical point of view, this first section 4 has an essentially rigid structure so that, in addition to its role of supplying the dipole 3, it plays the role of a mechanical support for this dipole on a central tower 9.

The second section 5 of the supply line runs inside the tower 9.

The tower 9 is made of a material forming a radio-electrical shielding so that the sections 5, which are generally vertical, do not disturb the pattern of the antenna, which also has a vertical direction of polarization.

In the embodiment of FIG. 1, the active modules 6 are placed at the end of the section 5 of the supply line, in the vicinity of the distributor 7 (generally located at the base of the antenna or at the base of the tower).

By contrast, in the embodiment of FIG. 2, the active modules 6 are placed inside the tower 9, at the end of the horizontal section 4.

Although this second configuration calls for an increase in the diameter of the tower 9 to make it possible to house the active modules of the different elementary antennas, it has the advantage of reducing the distance between each elementary antenna and its associated active module to the minimum, thus enabling a substantial improvement in the performance characteristics of the antenna, from the viewpoint of both the signal-to-noise ratio and the disturbances caused by the inherent phase shifts of the supply lines.

In one variant (not shown), the active modules may also contain transmission and reception means. In this case they are positioned, for example, in the same way as the phase-shifter means 6 shown in FIGS. 1 and 2. The distribution means would no longer appear in this example.

The vertical tower 9 may have (notably in the embodiment of FIG. 1) a very small diameter (less than one wavelength) and may consequently contribute only a minimal degree of inconvenience to the almost hemispherical pattern of each elementary antenna.

All the elements of the array may be placed in an open space or else inside a protective radome or else, again, they may be buried in an appropriate material such as polyurethane foam (although this approach, as indicated further above, is not satisfactory from the viewpoint of heat dissipation when the array is used in transmission).

The enveloping volume, in its simplest shape, is a sphere.

However, this shape is not restrictive and it is possible to contemplate other shapes of enveloping volumes, namely shapes with a height/main diameter ratio which is different from 1, provided that these are shapes generated by revolution.

This choice actually depends on the narrowness of the desired beam as a function of the elevation angle. A spherical volume corresponds to a substantially uniform beam irrespectively of the elevation angle while a flattened shape, close to that of a disk, will make it possible to obtain the narrowness of the beam essentially for great elevation angles.

In other words, it is the apparent contour of the enveloping volume, seen from the target, that will determine the narrowness of the beam.

As for the number of dipoles in the array, the relative mean spacing between these dipoles and the diameter of the enveloping volume may vary greatly as a function of the desired performance characteristics:

Essentially:

the number of elementary antennas determines the gain of the antenna in the chosen direction: the greater the number of elementary antennas, the higher is this gain; and the diameter of the sphere determines the narrowness of the beam; the greater the size of the sphere, the narrower is the beam in the determined direction. Typically, for a narrow beam, with an aperture of about 1° at −3 dB, it is necessary to provide for a sphere having a diameter of the order of 70 wavelengths.

Figure 3:
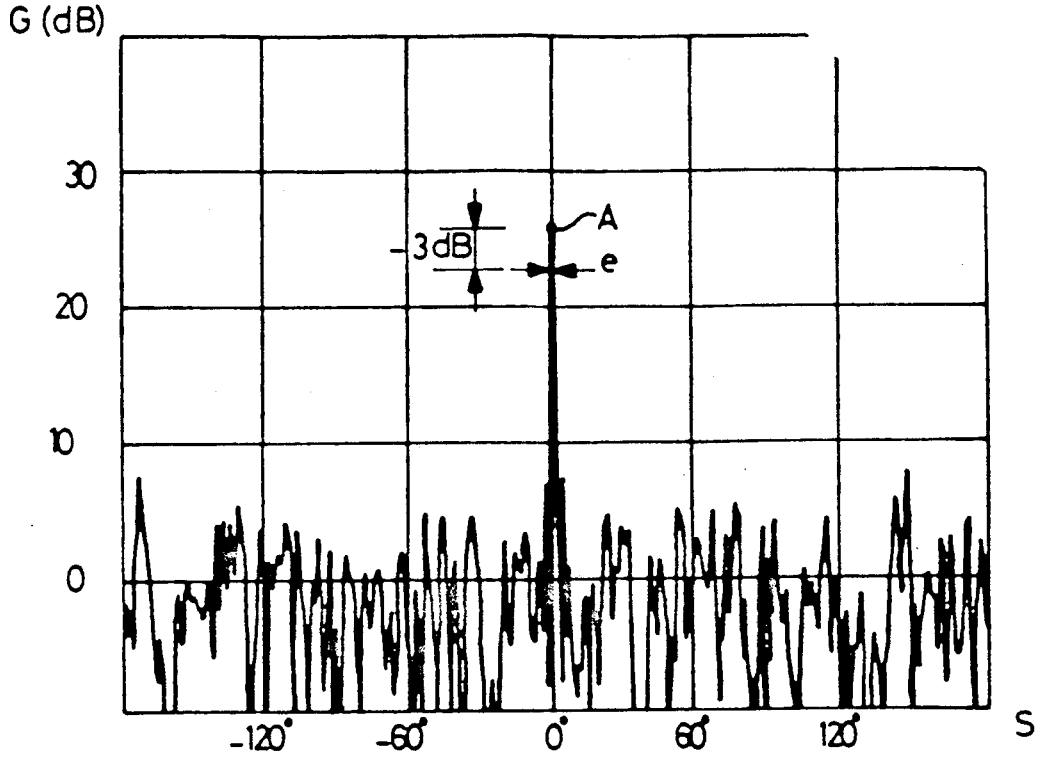
FIGS. 3 and 4 are graphs giving the gain as a function of the elevation angle of the array according to the invention.
Figure 4:
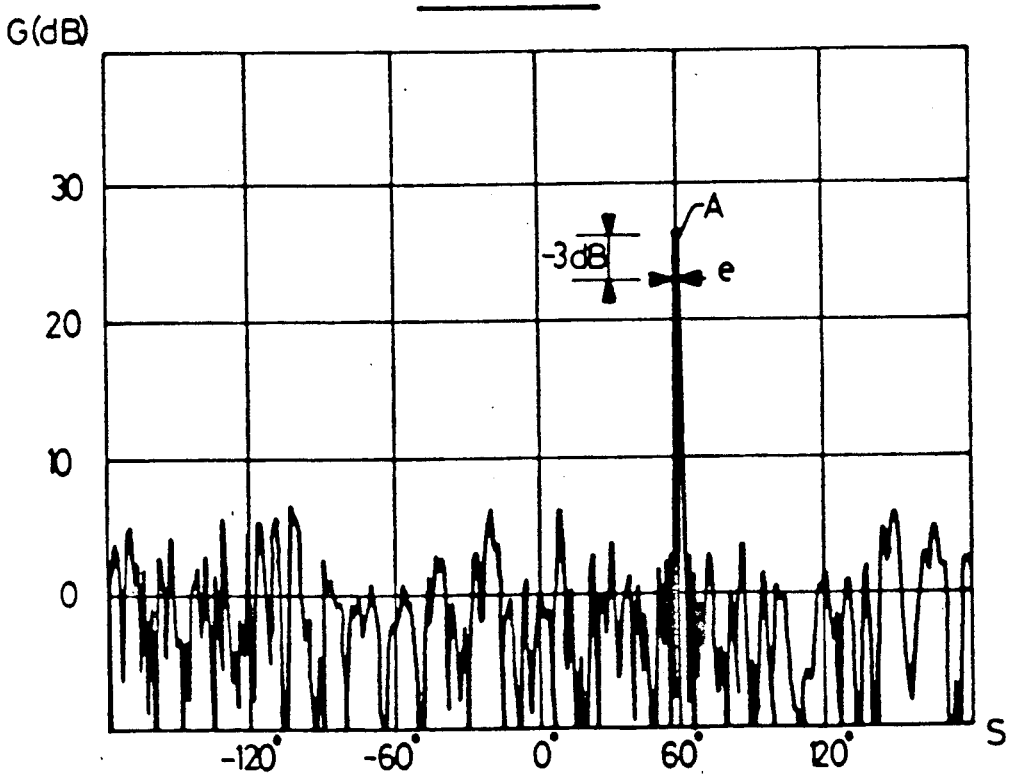

FIGS. 3 and 4 illustrate the performance characteristics obtained with an array made according to the teachings of the invention, comprising 377 sources distributed with a mean pitch of 3 wavelengths and a mean random deviation of ±1.5 wavelength.

In the two graphs, the gain G has been shown as a function of the elevation angle (the azimuthal angle being fixed in both figures at 60°).

FIG. 3 corresponds to an aiming of the beam at an elevation angle of 0°, while FIG. 4 corresponds to an aiming at an elevation angle of 60°.

We thus obtain a width of the beam, at −3 dB, of 2.52° in the former case and 2.56° in the latter case. In the latter case, we should emphasize the excellent performance characteristics of narrowness of the beam although we have, at the same time, a big elevation angle (60°) and a big azimuthal angle (60° too). Also to be noted is an absence of variation of the maximum gain (point A) in either case, which reveals an excellent isotropy in elevation.

The antenna according to the invention lends itself to numerous applications, among which we might indicate:

radars on board ships where there is typically the need for both hemispherical coverage and vertical polarization to get rid of the effects of reflection on the sea;

IFF radars and tracking radars for weapons systems, for which a continuous rotation of the beam is ill-suited. For, once the threats are localized, it is necessary to be capable of exchanging information sequentially in a plurality of well-determined directions, capable of extending throughout the horizon and with big elevation angles, these being directions which, desirably, should be capable of being reached selectively without it being necessary to scan the entire horizon as is the case, presently, with continuous rotation radars.

What is claimed is:

1. An antenna with three-dimensional coverage and electronic scanning, said antenna being of the randomly-distributed, rarefied, volume array type, with a fixed array comprising a plurality of elementary antennas each having a substantially omnidirectional radiation pattern, said elementary antennas being distributed according to a statistically isotropic random relationship within a boundary volume which is a volume of revolution, the mean value of the spacing between said elementary antennas being substantially greater than a half wavelength of the minimum frequency to be received or transmitted, each elementary antenna being connected to individually controllable phase-shifter means, wherein said elementary antennas are vertically-oriented dipoles, and wherein said dipoles are each fed by a supply line comprising a first section extending horizontally between the respective dipole and a common vertical tower, said tower being coaxial with said boundary volume which is a volume of revolution.

2. An antenna according to claim 1, wherein said boundary volume is a sphere.

3. An antenna according to claim 1, wherein said first sections of the supply lines are self-supporting means mechanically supporting the respective dipoles on said common vertical tower.

4. An antenna according to claim 1, wherein the supply lines comprising said first sections further comprise respective second sections extending inside said tower up to, or down to, said individually controllable phase-shifter means.

5. An antenna according to claim 1, wherein said individually controllable phase-shifter means comprise active modules connected to a respective elementary antenna.

6. An antenna according to claim 5, wherein said active modules are paced on the supply line inside said tower.

7. An antenna according to claim 1, wherein said dipoles are made from thin wires.

* * * * *